United States Patent [19]

Kolkhorst

[11] Patent Number: 4,978,267

[45] Date of Patent: Dec. 18, 1990

[54] DEVICE FOR CASING INNER BOOKS IN BOOK COVERS

[75] Inventor: Helmut Kolkhorst, Rahden, Fed. Rep. of Germany

[73] Assignee: Kolbus GmbH KG, Rahden, Fed. Rep. of Germany

[21] Appl. No.: 454,816

[22] Filed: Dec. 21, 1989

[30] Foreign Application Priority Data

Dec. 24, 1988 [DE] Fed. Rep. of Germany ..... 88160335[U]

[51] Int. Cl.[5] ..... B42C 11/04

[52] U.S. Cl. ..... 412/21; 412/4; 412/5; 412/19; 412/20

[58] Field of Search ..... 412/19, 20, 21, 4, 5

[56] References Cited

U.S. PATENT DOCUMENTS

| | | | |
|---|---|---|---|
| 3,394,418 | 7/1968 | Thorp | 412/21 |
| 3,708,813 | 1/1973 | Carter et al. | 412/5 |
| 4,153,963 | 5/1979 | Hawkes et al. | 412/21 |
| 4,505,629 | 3/1985 | Lynch | 412/19 |

FOREIGN PATENT DOCUMENTS

| | | | |
|---|---|---|---|
| 1536505 | 5/1970 | Fed. Rep. of Germany . | |
| 1786038 | 11/1971 | Fed. Rep. of Germany | 412/21 |
| 7514086 | 12/1975 | Fed. Rep. of Germany . | |

*Primary Examiner*—Paul A. Bell
*Assistant Examiner*—Hwei-Siu Payer
*Attorney, Agent, or Firm*—Klein & Vibber

[57] ABSTRACT

A device is used for casing inner books in book covers. The device reciprocates in a vertical direction synchronously with an inner book conveyor. A feed roll system is provided for enclosing the inner book in the book cover. A clamping mechanism is provided for receiving and positioning the cover spine. A pair of alignment elements form part of the clamping mechanism and are operatively connected to an actuating device so as to move from first lateral positions relative to the plane of travel of the inner book towards the book cover, thereby centering the spine of the book cover relative to the plane of travel of the inner book and aligning it in a direction normal to the plane of travel of the inner book. Hold-down elements are provided for holding the book cover against a support surface during centering and alignment.

3 Claims, 4 Drawing Sheets

DEVICE FOR CASING INNER BOOKS IN BOOK COVERS

BACKGROUND OF THE INVENTION:

The present invention relates to a device for casing inner books in book covers consisting of a casing-in device, which rises synchronously with the movement of an inner book conveyor. The device also includes a feed roll system for enclosing the inner book in the book cover and a clamp which accommodates and locates the cover spine.

Book centering devices constructed along the aforedescribed lines, have proven successful in high-performance automatic casing-in machines for casing in thinner books in covers in exact register. Hold-down elements used for centering a book are known in the art. Such state of the art devices are less suitable for casing inner books and covers which have a large fold width between the spine and the covers.

Book covers having such large fold width have, as is known in the art, a spine section preformed at right angles to the feed direction. Such book covers are used for thin-side-sewn inner books. With such side-sewn book products the cover spine consists of a relatively narrow but thick board. These narrow spine sections have, generally, a tendency to warp, on the one hand, and the low inherent strength of the covering material, on the other hand, cause the formation of U-shaped spine sections, which are formed in the cover forming the station, thereby losing their alignments at right angles to the center of the cover in transit to the casing-in station.

The casing-in operation can then not be achieved in as exact register as is desirable, and the book spine is not precisely formed at right angles. This problem occurs to an even greater extent with warped covers and crookedly sewn, inner books and also with thin-large-format products.

SUMMARY OF THE INVENTION

It is a general object of this invention to produce a device for casing inner books of the type described hereinabove, which provides an exact register with a straight spine when casing thin inner books having a wide fold area. Such a device guarantees a centered, right-angled alignment of the spine of the cover relative to the plane of travel of the inner book.

This object of the invention is achieved by providing a centering device which includes a clamp which consists of alignment elements which are moved by means of actuating devices from lateral positions to the plane of travel of the inner book, thereby centering the spine of the book relative to the plane of travel of the inner book and aligning it at right angles, and by providing hold-down elements which hold the book cover against the support surface during centering and alignment.

The alignment elements have preferably a contoured actuating surface which corresponds to the fold shape of the book cover.

In accordance with a further advantageous feature of the invention the complimentary alignment elements are laterally offset relative to each other and extend to a point above the middle of the inner book.

BRIEF DESCRIPTION OF THE DRAWING

For an understanding of the principles of the invention, reference is made to the following description of a typical embodiment thereof as illustrated in the accompanying drawing.

DETAILED DESCRIPTION

There is illustrated in FIGS. 1 to 4 an inner book 1*b* which is to be cased in a cover 1*a*. This inner book 1*b* is carried astride a saddle 2 which synchronously reciprocates and is continually circulated by means of a non-illustrated conveyor. As is known in the art, the inner book is enclosed by the cover by means of feed rolls 3, which are located on both sides of the travel path. The feed rolls 3 are reciprocally removable up and down by a separate non-illustrated chain system and support freely rotatable roller bodies 3*a*. These roller bodies 3*a* initially engage the cover and travel upwards, after which movement they reverse direction of travel and enclose the inner book in the cover. Such an operation is, for example, described in German published application No. 1536505 and the corresponding U.S. Pat. No. 3,394,418.

Figure 4:
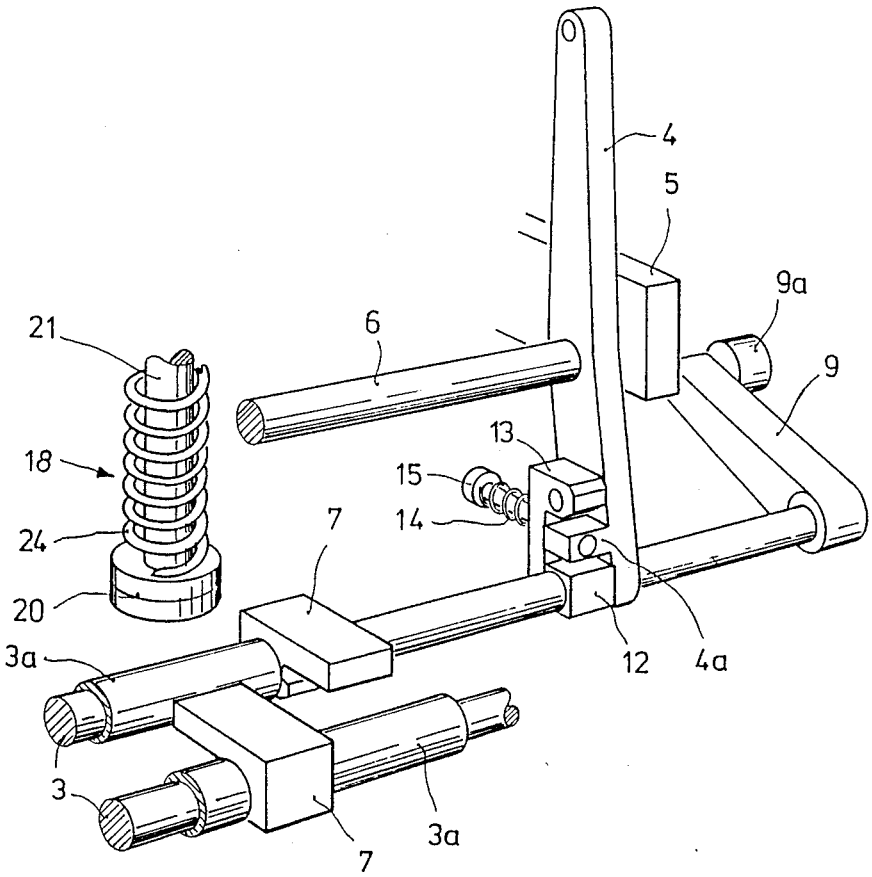
FIG. 4 is a perspective view of an enlarged portion of the device illustrated in FIGS. 1 to 3 in which the alignment elements are shown in a first operative position.
Figure 5:
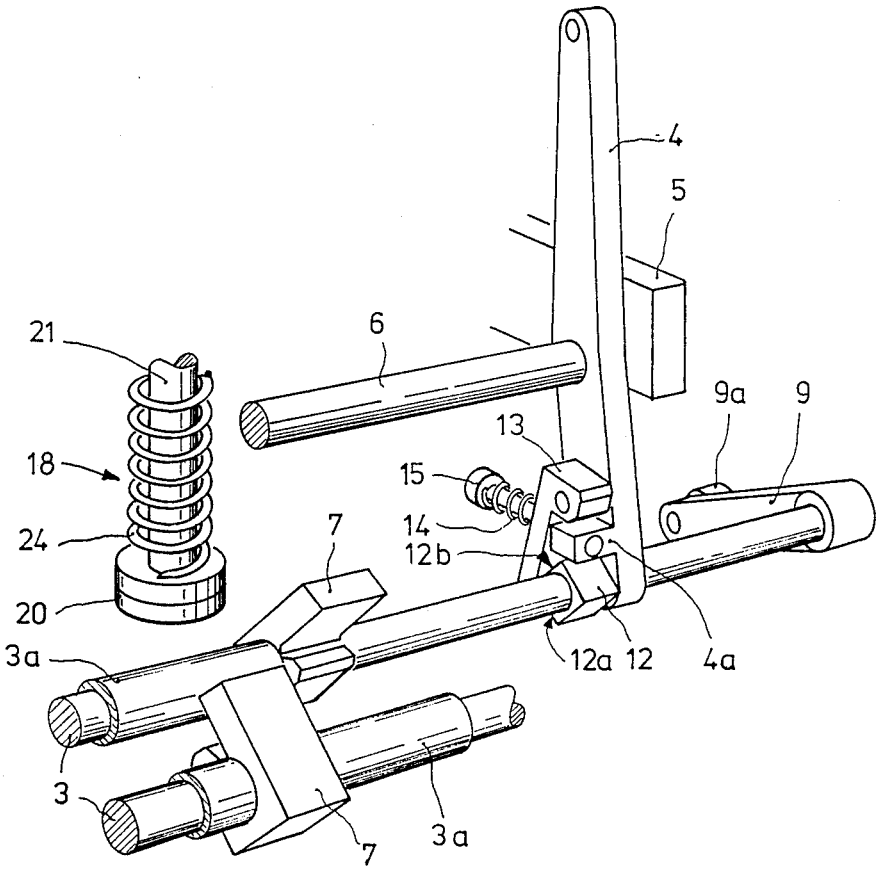
FIG. 5 is a perspective view of an enlarged portion of the device illustrated in FIGS. 1 to 3 in which the alignment elements are shown in a second operative position.

As is illustrated in FIG. 4, the feed rolls 3 are mounted in bearings in elbow levers 4, which in turn are mounted on a transverse shaft 6, attached to the lateral elements 5 of the casing-in device.

Complimentary alignment elements 7 are provided. Generally a pair of alignment elements 7 are mounted at a predetermined distance from each other and are configured on the feed rolls 3 so as to accommodate and locate the spine of the cover. The distance between the alignment elements 7 on each feed roll 3 can be adjusted so as to take in account the cover format by means of which are not illustrated herein.

As is illustrated i n FIG. 4, the pairs of complimentary alignment elements 7 are mounted laterally offset relative to each other on their respective feed rolls 3 so as to allow for variations in the cover spine width. These complimentary alignment elements extend to a point above the middle of the inner book 1*b*. (see FIG. 3)

Figure 1:
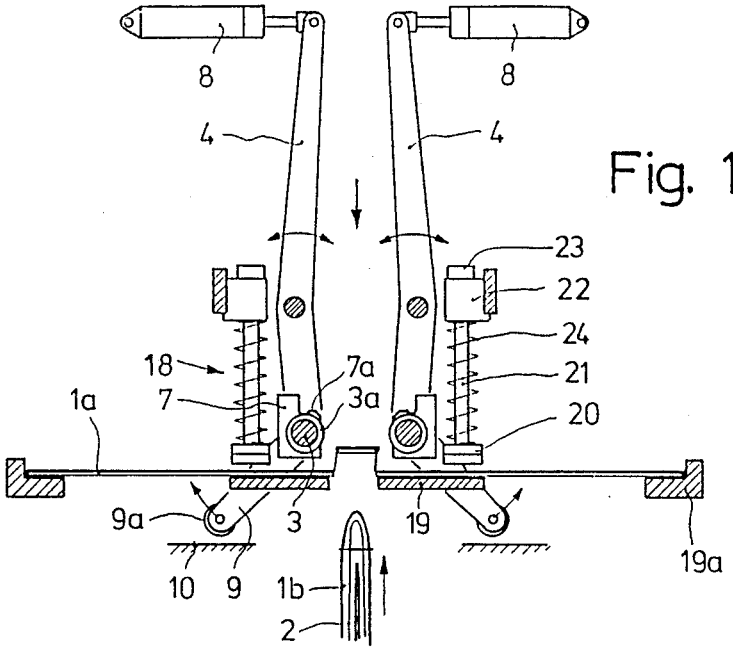
FIGS. 1 to 3 illustrate schematically inside elevational partially cross-sectional views of the casing-in device in various phases of motion.

In accordance with the invention, the alignment elements 7 are moved by activating the elbow levers 4 by means of actuating hydraulic cylinder 8 which positions the lever 4 in the direction of the double arrows illustrated in FIG. 1. Thus, the hydraulic actuating cylinders 8 move the elbow levers 4 from a first lateral position (FIG. 1) to a second lateral position (FIG. 3) in the plane of travel in the inner book cover la, which is formed in a cover forming station (not illustrated). In this cover forming station the cover 10 is centered and aligned at right angles to the plane of travel of the inner book 1*b*.

In order to achieve an optimum location of the covers 1*a* relative to the inner book 1*b* the alignment elements 7 are provided with a contoured contacting face 7*a* which corresponds to the fold shape of the book cover 1*a*.

Figure 2:
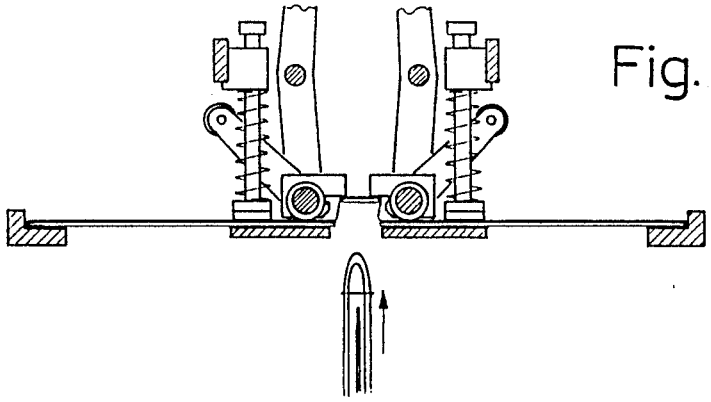
Figure 6:
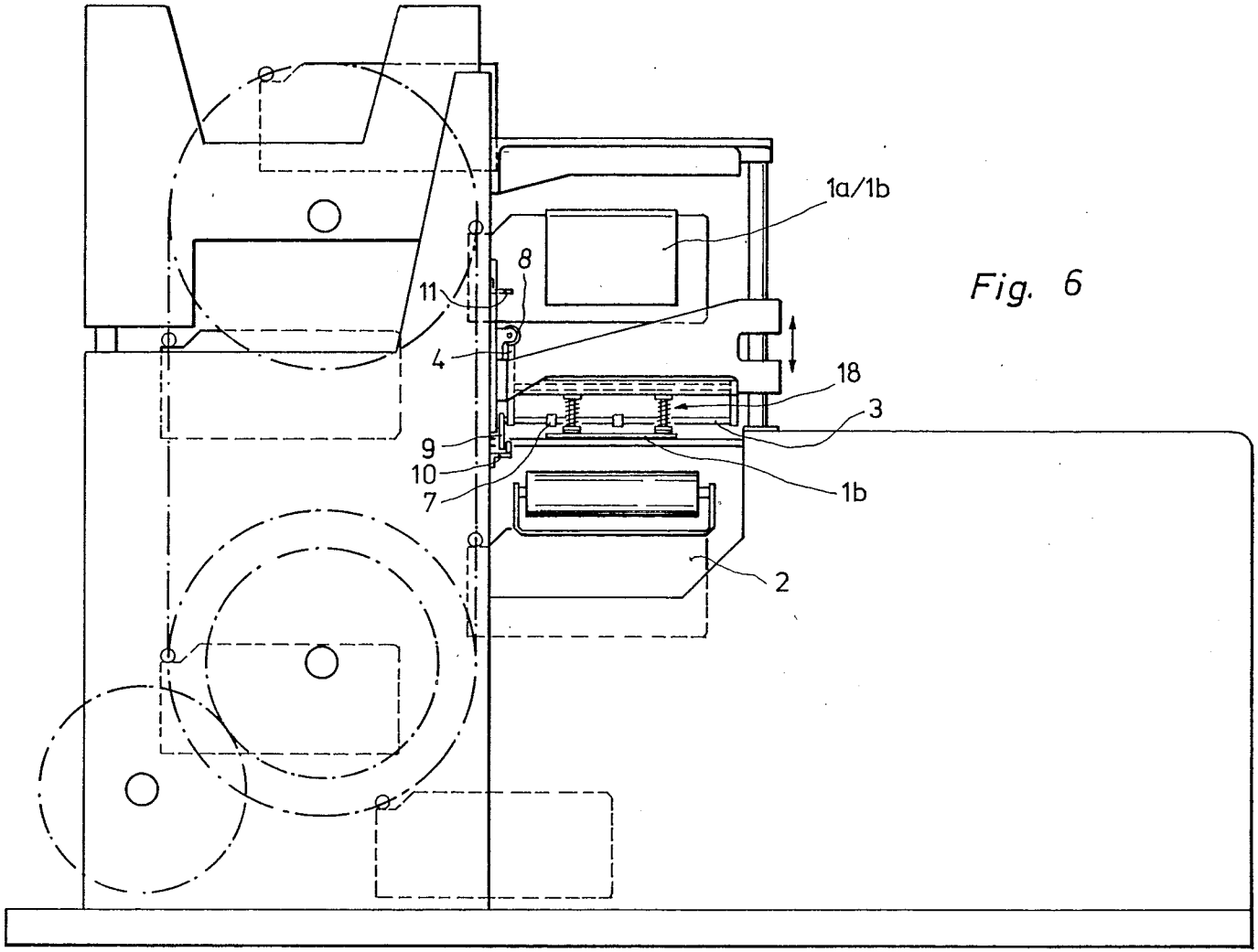
FIG. 6 is a side elevational view of a casing-in machine incorporating the construction of the invention.

The swiveling of the alignment elements 7 from their open vertical position, as shown in FIG. 1, to the horizontal alignment position, as shown in FIG. 2, is effected by means of Pitman arms 9 which are rigidly connected to the feed rolls 3 on the free ends thereof. These Pitman arms 9 have control casters 9*a* which coact with contacting surfaces 10 and 11 (see FIGS. 1 and 6). Each one of the feed rolls 3 is provided with a square stop 12, mounted thereon, which is adapted to flushly abut against the swivel arm 13 mounted on the elbow lever 4, in order to lock the alignment elements 7 in each swivel terminal position. To this end, a pin 15 is seated in an extension arm 4*a* of the elbow lever 4, thereby engaging the swivel arm 13. The compression spring 14 presses against the head of the pin 15 and holds the swivel arm 13 continuously against the square stop 12.

Finally, the casing-in device, is provided with spring-loaded hold-down elements 18 which press the cover la against the support surfaces 19. Additionally lateral guides 19*a* are provided for supporting the cover 1*a*. The hold-down element 18 includes the pressure plate 20 mounted on a rod 21 which is mounted in a seat 22 so that it can be axially displaced, where by the seat 22 is moveable by the casing-in device as it travels between an upper and lower terminal position. A retaining plate 23 is also located at the side opposite to the end of the rod 21 which has the pressure plate 20. The force required for the compression against the cover 1*a* is provided by means of a compression spring 24 which is coaxially mounted on the rod 21 and is displaced between the seat 22 and the pressure plate 20.

MANNER OF OPERATION

The book cover 1*a*, which is preformed in a nonillustrated cover forming station is fed to the support surfaces 19 and is aligned laterally against the guides 19*a*. As the casing-in device travels downwardly into its lower terminal position, the spring-loaded hold-down elements 18 press the cover 1*a* against the support surfaces 19 (FIG. 2). It is the roller bodies 3*a* of the feed rolls 3 that contact the cover 1*a*, the alignment elements 7 swivel from their open vertical position to the horizontal position, which swivel movement is effectuated by the control castors 9*a* of the Pitman arms 9 which contact the lower control surfaces 10. The alignment devices 7 are locked into their horizontal alignment position via the square stops 12 which are disposed on the ends of the feed rolls 3, and which interact by means of the compression springs 14 with the swivel arms 13.

Figure 3:
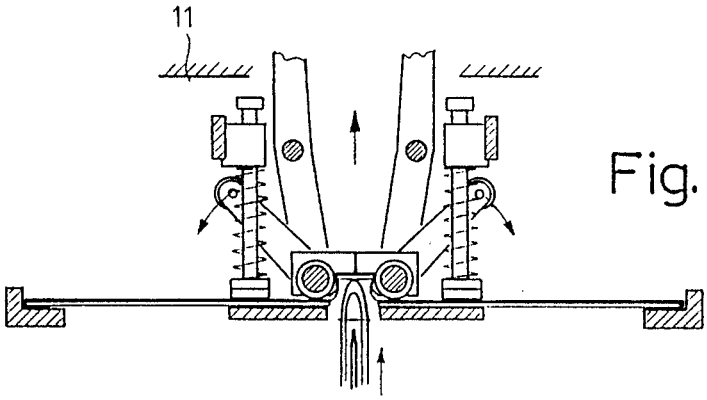

The clearance between the lower edge of the roller bodies 3*a* and the horizontal actuating face of the alignment elements 7 is selected so that, once they have been rotated, they lie against the spine of the cover with light pressure from above (See FIGS. 2 and 3).

The alignment devices 7, when located in their horizontal alignment positions, are moved, inwardly by activating the elbow levers 4 by means of the activating cylinders 8, as a result of which the spine of the cover 1*a* is clamped by the alignments devices 7 so that it is centered and aligned at right angles to the plane of travel of the inner book 1*b*.

The book cover 1*a*, which is centered as described hereinabove and aligned at right angles to the direction of travel of the inner book 1*b* and is disposed in a ready position on the support surfaces 19, is then moved by the subsequent upward motion of the inner book 1*b*, carried astride on the saddle 2 of the non-illustrated conveyor device. This upward movement ends at the position illustrated in FIG. 3 where the alignment devices 7 are located as shown. The alignment devices 7 rise synchronously with the saddle 2, maintain the centered, aligned position of the spine of the book until the control castors 9*a* contact the upper control surfaces 11, which results in the alignment devices 7 reverting to their open, vertical position, thereby releasing the cover 1*a* and inner book 1*b*. Simultaneously with this operation the inner book 1*b* is enclosed in the cover of 1*a* by the downward motion of the feed rolls 3, with their roller bodies 3*a* which move to the lower terminal position. (Not illustrated).

While a specific embodiment of the invention has been shown and described in detail to illustrate the application of the principles of the invention, it will be understood that the invention maY be embodied otherwise without departing from such principles.

I claim:

1. Device for casing inner books in book covers, including an inner book conveyor, and a casing-in device for moving the inner books along a plane of travel which rises synchronously with the inner book conveyor, comprising a feed roll system to enclose the inner book in the book cover said system includes a pair of clamps for accommodating and locating the spine of the book cover said pair of clamps includes a pair of complementary alignment elements which are moved by means of actuating devices from lateral positions toward the plane of travel of the inner book, thereby centering the spine of the book cover relative to the plane of travel of the inner book and aligning it at right angles thereto, and including hold-down elements operatively mounted in said device for holding the book covers against a support surface during centering and alignment.

2. Device according to claim 1, wherein the book covers have a predetermined fold shape, said complementary alignment elements are provided with a contoured locating face which corresponds to the fold shape of the book covers.

3. Device according to claim 1, wherein said complementary alignment elements are laterally offset relative to each other and extend to a point above the middle of the inner book.

* * * * *